United States Patent [19]

Thomson

[11] 4,000,802

[45] Jan. 4, 1977

[54] TYPE BAR ACTUATING MECHANISM

[75] Inventor: James E. Thomson, Pleasant Lake, Mich.

[73] Assignee: Western Stamping Corporation, Jackson, Mich.

[22] Filed: Apr. 21, 1975

[21] Appl. No.: 570,168

[52] U.S. Cl. ..... 197/27; 197/22

[51] Int. Cl.[2] ..... B41J 7/00

[58] Field of Search ..... 197/17, 22, 27, 28

[56] References Cited

UNITED STATES PATENTS

| | | | |
|---|---|---|---|
| 722,291 | 3/1903 | Ferguson | 197/22 |
| 1,058,688 | 4/1913 | Myers | 197/33 X |
| 2,937,736 | 5/1960 | Kuntzel | 197/27 X |
| 3,108,674 | 10/1963 | Byers | 197/27 |

FOREIGN PATENTS OR APPLICATIONS

| | | | |
|---|---|---|---|
| 358,204 | 3/1921 | Germany | 197/27 |

*Primary Examiner*—E. H. Eickholt
*Assistant Examiner*—Paul T. Sewell
*Attorney, Agent, or Firm*—Harness, Dickey & Pierce

[57] ABSTRACT

Type bar actuating mechanism for typewriters comprises a cord connected to each type bar. Each cord is attached to an individual type bar at a position below the pivot axis of the type bar and extends forwardly to a keyboard area, where it is attached to a fixed support. In the keyboard area, each cord extends through a slot in a sleeve-like vertical plunger guide, which is open at the top and which contains a plunger which extends upwardly to a finger piece conventionally arranged in the keyboard section. Between the plunger guide and the type bar the cord extends over a wall having a smooth top over which the cord is freely slidable. When the finger piece is depressed, the plunger pulls the cord over the wall and forces it down inside the sleeve.

2 Claims, 3 Drawing Figures

TYPE BAR ACTUATING MECHANISM

BACKGROUND OF THE INVENTION

The use of cords and the like to actuate the type bars of typewriters has been proposed and utilized for many years. In modern times, the development of very strong and long-lasting flexible manmade fibers, such as nylon, has rendered it practical to utilize cord actuation to replace the metallic linkages which were almost universally used for many years. In one popular type of toy typewriter, nylon cords are employed which are secured to the bottoms of plunger-type keys which, when depressed, pull the cord to actuate the type bars. This arrangement has involved the use of keys of unattractive appearance, because thin exposed stem portions were required in order to pull the cords. In addition, the operating characteristics of such systems have suffered from the shortcoming that the force required to depress the keys was at its maximum at the beginning of the stroke.

The present invention aims to provide an improved actuating mechanism wherein the force required to depress the key is at a minimum initially and the mechanical advantage decreases and the rate of speed of the type bar increases as the key is depressed, so that the "feel" is improved, and the type bars strike the paper at maximum velocity.

A related object is to provide such a mechanism in which the characteristics just discussed relating to the ratio of key pressure and speed throughout the stroke can be accurately pre-set by the designer, and is uniform for all keys. Another related object is to provide such a mechanism which is inexpensive in construction and simple and inexpensive to assemble, as a result of which the cost of the typewriter to the consumer can be substantially reduced.

Other objects and advantages will become apparent upon consideration of the present disclosure in its entirety.

BRIEF DESCRIPTION OF THE FIGURES OF DRAWING

DETAILED DESCRIPTION OF THE PREFERRED FORM OF THE INVENTION

Figure 1:
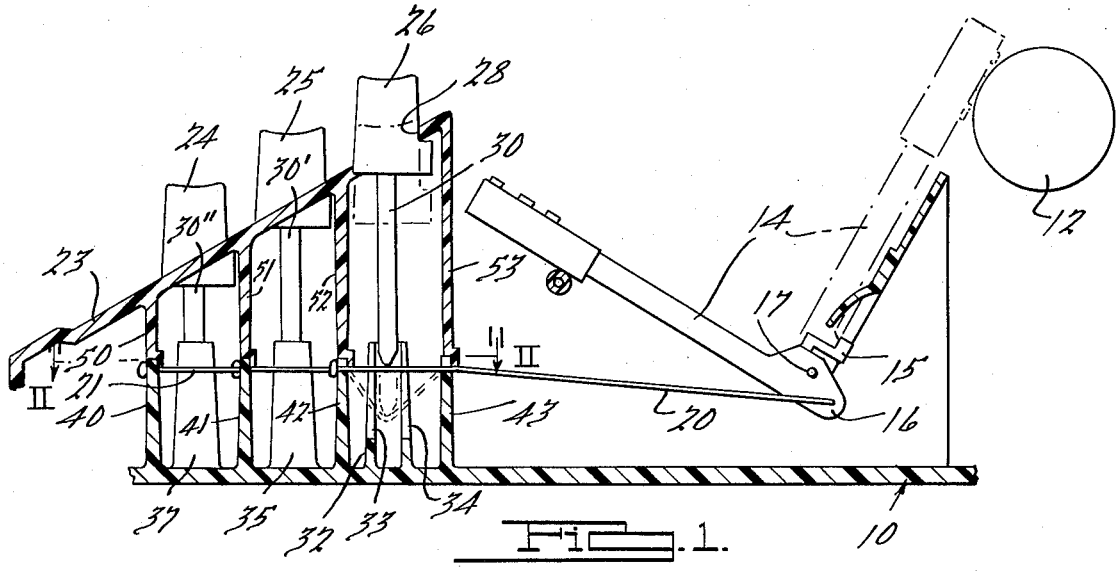
FIG. 1 is a somewhat diagrammatic fragmentary vertical sectional elevational view of a typewriter mechanism incorporating type bar actuating means constructed in accordance with the present invention.
Figure 2:
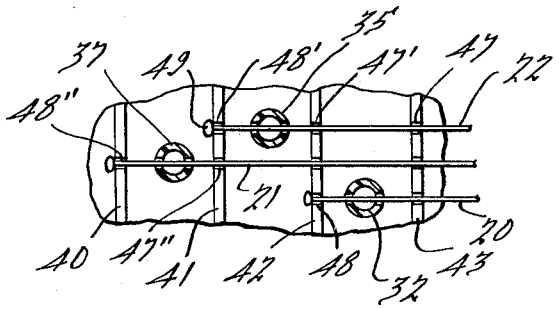
FIG. 2 is a fragmentary horizontal sectional plan view taken substantially on the line II—II of FIG. 1.

Reference character 10 designates generally the base frame portion of a typewriter which is illustrated as having a platen 12 upon which the paper to be imprinted is adapted to be rolled and overlaid in the usual manner. The details of construction of the platen and its actuating means form no part of the present invention and will not require description.

The type bars 14 are levers of the first class pivoted in the usual manner in a supporting segment 15. Each type bar has a short arm 16 which extends below its pivot 17 and to which an actuating cord as 20, 21, 22 is secured.

The actuating cord for each type bar extends forwardly beneath a keyboard which is defined by an inclined keyboard cover portion 23 supported by the frame portion 10. In the illustrated construction, the keyboard has three banks of keys, as is common in toy and junior typewriters, although a four-bank keyboard or other arrangement might be used. A vertically movable plunger-type finger piece or key is provided in the conventional or any suitable arrangement for each of the type bars 14. In the construction shown the keys of the front row are designated 24, the keys of the middle row are designated 25, and the keys of the back row are designated 26. The keys may be of oval or other nonconcentric cross section in a horizontal plane, as shown, and slidable in conformably shaped, closely fitting openings as 28 in the keyboard 23, so that the keys cannot rotate about a vertical axis. Below the keyboard each key carries rigidly attached thereto a straight vertical stem portion 30'30, 30!, 30'' which extends downwardly and projects a short distance into and is slidable in one of a plurality of tubular open-topped guide bosses 32, 35, 37 shown as molded integrally with and upstanding from the base portion 10. The keys are thus guided at the upper end by the closely fitting openings 28 and at the lower end by the relatively close fit of their stems in the hollow guide bosses.

Extending transversely across the machine in front of and behind each row of bosses and spaced uniformly therefrom are a plurality of wall portions 40, 41, 42, 43 integral with and upstanding from base 10. Back wall 43, nearest the type bars, has a plurality of notches as 47 in its top, one notch being provided for each of the cords. The walls 40–43 are of uniform height, their tops being somewhat lower than the tops of the bosses. The bottom of each of the notches 47 in wall 43 is overlaid by one of the cords and is preferably smoothly rounded, as are the other corresponding notches. The cords may be of nylon, as indicated, and the walls are also formed of a plastic having good bearing characteristics so that the cords will slide easily thereover.

The cords for the rear row keys 26 are shown as anchored to the wall 42 which lies between the middle and back row, although it will be recognized that all of the cords could be extended to and secured in the front wall 40. The cords for the keys 25 of the middle row extend over notches 47' in wall 42 corresponding to the notches 47, and as shown are anchored to the wall 41 which lies between the front and middle row keys, while the cords for the front row of keys 24 extend over notches 47'' in wall 41 corresponding to notches 47 and are anchored in the front wall 40.

At each anchor position the top of the wall is provided with a narrow slot 48, 48', 48'', and the forward end of the cord has a knob or enlargement 49 fast thereon and which lies behind and is larger than the slot so that the cord is prevented from being pulled rearwardly.

Each of the cords 20 for connection to one of the back row keys 26 extends freely through aligned coplanar vertical slots 33, 34 in the front and rear walls respectively of the bosses 32 of the rear row and is anchored in the wall 42, in the manner described. The type bar actuating cords for the middle row of keys 25 extend between the rear bosses 32, uninterruptedly through slots 47' on the top of wall 42 and through slots in the middle row bosses 35 corresponding to slots 33, 34 and to the anchor position. Similarly the type actuating cords for the front row keys 24 extend freely through notches 47, 47′, 47″ in the tops of walls 43, 42, 41, and between the rear and middle row bosses 32, 35, through slots in the front row bosses 37, and are anchored in like fashion in the front wall 40.

It will be recognized that if all of the cords are extended to and secured to the forward wall, 40, rather than always anchored in the closest wall on the front side of the effective key stem, the closest wall toward the front will nevertheless constitute the effective anchor in each instance, and is to be considered as such in interpreting the claims hereof.

Figure 3:
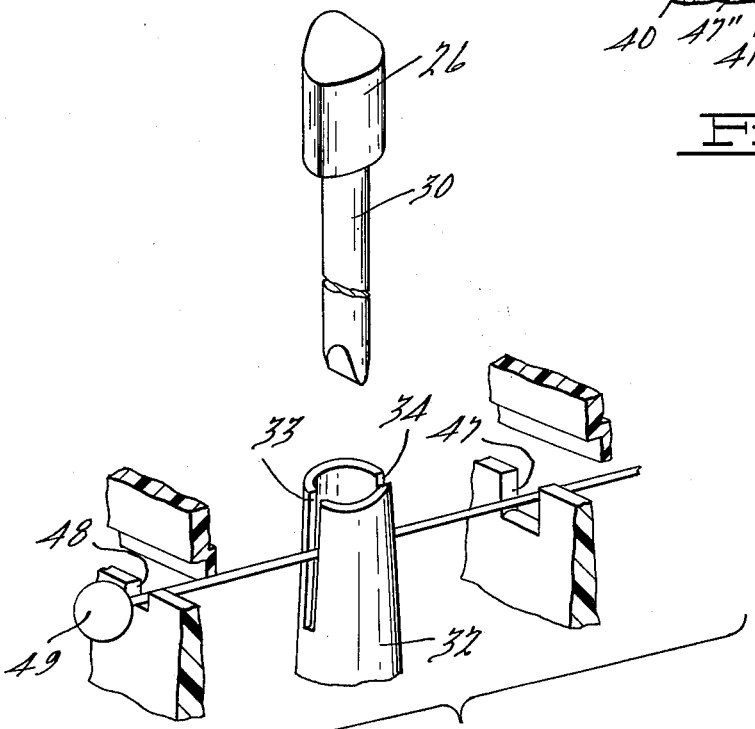
FIG. 3 is an enlarged exploded perspective view of the principal components at one of the actuating plunger positions.

The cords are trapped in their respective notches of the upstanding transverse walls 40–43 by aligned depending transverse wall portions 50, 51, 52, 53, shown as molded integrally with and depending from the keyboard section 23. As shown in FIG. 3, the bottoms of depending wall portions 50–53 are provided with forwardly offset portions as 54 adapted to overlap a part of the abutting lower wall 40–43, thereby preventing displacement of the cord in event the walls are distorted or are otherwise not in perfect alignment.

The bottom of each of the stems 30, 30′, 30″, is smoothly rounded, and the stem is of such length that when a key is in the normal raised position the rounded bottom portion 50 of the stem rests on the cord 20 with the cord stretched in a straight line between the anchoring wall and the bridged walls, the type bar at such time being retracted, as shown in full lines in FIG. 1. When the key is depressed the plunger forces downwardly and to an angular relationship the two portions of the cord lying between the two walls which lie to the front and rear of the depressed stem. At such time the cord moves freely downwardly in the slots as 33 and 34 in the guide boss, and is pulled over the closest bridged wall to actuate the connected type bar. The distances between the guide bosses and the transverse walls 40–43 are selected so as to give the desired travel and to interpose the desired actuating force. It will be seen that these factors can be varied by changing the distance between the walls and the bosses, and also by changing the distance between the axis 17 and the position of connection of the cord to the type bar arm 16.

This Detailed Description of Preferred Form of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. A type bar actuating mechanism for a typewriter of the class having a base, a keyboard with plunger-type keys, a plurality of type bar levers actuatable by means of cords, and a stem extending downwardly toward the base from each key and movable downwardly toward the base by depressing the key, including guide means for each stem carried by the base, the stems being slidably interengaged with the guide means, and anchoring means carried by the base at a position farther from the type lever than is the guide means, characterized by a cord attached to each type bar lever and extending beneath but in rubbing contact with the bottom of one of the stems and extending therebeyond to the anchoring means and attached to the anchoring means, a wall upstanding from the base at a position between the guide means and the type lever and against and over which the cords are pulled by the stems when the stems are depressed by the keys, the guide means comprising a tubular boss extending upwardly from the base in alignment with each stem to a position higher than the cord and in which the stem is slidable, each boss having vertically slotted portions through which one of said cords extends and in which the cord is vertically movable.

2. A type bar actuating mechanism as defined in claim 1 wherein each key and stem form a rigid vertically movable unit guided at the upper end by a keyboard portion carried by the base and guided at the lower end by the guide means.

* * * * *

UNITED STATES PATENT AND TRADEMARK OFFICE

CERTIFICATE OF CORRECTION

PATENT NO. : 4,000,802

DATED : January 4, 1977

INVENTOR(S) : James E. Thomson

It is certified that error appears in the above-identified patent and that said Letters Patent are hereby corrected as shown below:

Col. 1, line 64, after "bars" insert --as--.
Col. 2, line 19, after "portion" insert --as--.
Col. 2, line 19, "30' 30, 30!, 30" " should be --30, 30', 30"--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*